US008610637B1

(12) United States Patent
Steinbrecher

(10) Patent No.: US 8,610,637 B1
(45) Date of Patent: Dec. 17, 2013

(54) METHOD FOR ENABLING THE ELECTRONIC PROPAGATION MODE TRANSITION OF AN ELECTROMAGNETIC INTERFACE SYSTEM

(75) Inventor: Donald H. Steinbrecher, Brookline, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 416 days.

(21) Appl. No.: 13/134,957

(22) Filed: May 31, 2011

(51) Int. Cl.
*H01Q 1/50* (2006.01)

(52) U.S. Cl.
USPC ..... 343/859; 343/893

(58) Field of Classification Search
USPC ..... 343/859, 893, 770, 853, 767
See application file for complete search history.

(56) References Cited

U.S. PATENT DOCUMENTS

| | | | | |
|---|---|---|---|---|
| 6,021,241 | A * | 2/2000 | Bilbro et al. | 385/37 |
| 7,315,288 | B2 * | 1/2008 | Livingston et al. | 343/770 |
| 7,545,029 | B2 * | 6/2009 | Wilson et al. | 257/685 |
| 8,427,158 | B2 * | 4/2013 | Huish et al. | 324/318 |
| 2005/0052262 | A1 * | 3/2005 | Fukunaga et al. | 333/204 |
| 2005/0156802 | A1 * | 7/2005 | Livingston et al. | 343/770 |
| 2009/0315802 | A1 * | 12/2009 | Johansen et al. | 343/853 |

* cited by examiner

*Primary Examiner* — Thien M Le
(74) *Attorney, Agent, or Firm* — James M. Kasischke; Michael P. Stanley

(57) ABSTRACT

A propagating mode transition system provides a transition from a free-space-propagating electromagnetic energy field, which is partitioned by an array of elongate elements, to a transverse electromagnetic-mode propagating energy field in a transmission line. Electrically-conductive pads are disposed on a substrate with the pads being arranged in spaced-apart fashion. Each pad is substantially covered by and electrically coupled to one of the elongate elements at a base thereof such that portions of each pad not covered by the base are exposed. Each of a plurality of transmission line baluns extends through the substrate with one end thereof disposed between the exposed portions of two adjacent pads. Each balun includes two identical-width electrical conductors with each conductor being electrically coupled to one of the exposed portions.

9 Claims, 3 Drawing Sheets

METHOD FOR ENABLING THE ELECTRONIC PROPAGATION MODE TRANSITION OF AN ELECTROMAGNETIC INTERFACE SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to energy transmission interfaces, and more particularly to a propagating mode transition system that provides for bilateral transitioning between free-space-propagating electromagnetic energy and transverse electromagnetic (TEM)-mode propagating energy.

(2) Description of the Prior Art

An electromagnetic radiation interface system and method are disclosed in U.S. Pat. No. 7,420,522 (issued on Sep. 2, 2008). Briefly, the interface is defined by an array of partition elements in the form of pyramidal bristles. The partition elements define an air or space interface between wide-bandwidth electromagnetic radiation and one or more processors. The partition elements can be used in both reception and transmission of electromagnetic radiation.

For efficient operation, there must be a low-loss propagating mode transition system coupled to the partition elements in order to enable low-loss conversion of the free-space-propagating electromagnetic energy captured/transmitted by the partition elements into "transverse electromagnetic" (TEM)-mode propagating energy. Due to the close-pack nature of the array of partition elements (i.e., smaller than a wavelength of operation), propagating mode transition must take place in confined spaces.

SUMMARY OF THE INVENTION

Accordingly, it is a primary object and general purpose of the present invention to provide a propagating mode transition system that can bilaterally define a transition mode between free-space-propagating electromagnetic energy and TEM-mode propagating energy where the free-space-propagating electromagnetic energy is captured by or transmitted from an array of elongated elements.

In accordance with the present invention, a system for transitioning free-space-propagating electromagnetic energy that is partitioned by a plurality of pyramidal elements into transverse electromagnetic (TEM)-mode propagating energy in a transmission line is provided. An array of electrically-conductive pads is disposed on a substrate with the pads being arranged in spaced-apart fashion. Each pad is substantially covered by and electrically coupled to one of the pyramidal elongate elements at a base thereof such that portions of each pad not covered by the square base are exposed. Each of a plurality of baluns extends through the substrate with one end thereof disposed between the exposed portions of two adjacent pads. Each balun is defined by a dielectric material sandwiched between two identical width electrical conductors that form a parallel plate TEM-mode transmission line. Each of the electrical conductors is electrically coupled to one of the exposed portions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
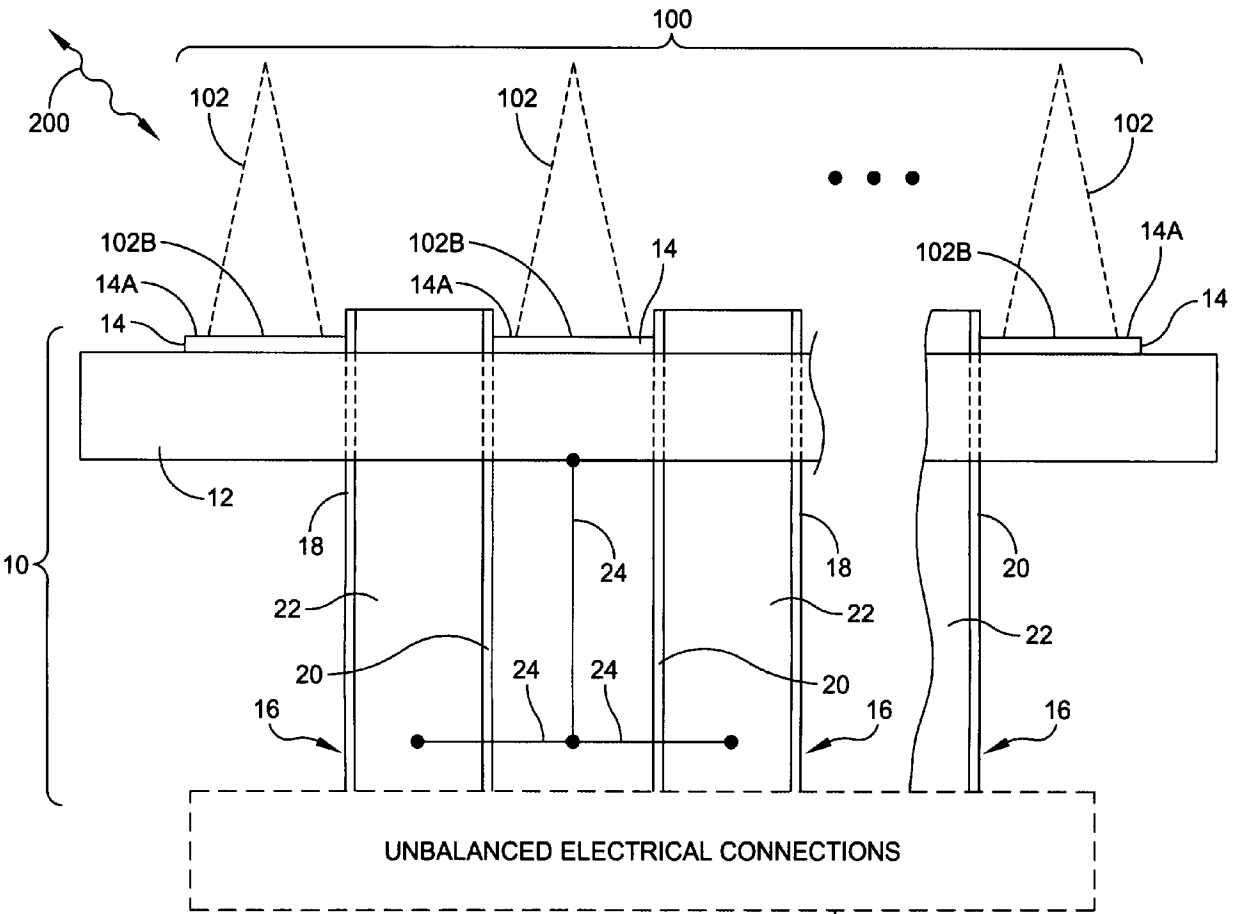
FIG. 1 is a side view of a propagating mode transition system in accordance with an embodiment of the present invention where the system is coupled to an array of elongate partition elements that serve as an interface with free-space-propagating electromagnetic energy.

Referring now to the drawings and more particularly to FIG. 1, a propagating transition mode system in accordance with the present invention is shown and is referenced by numeral 10. In general, the system 10 provides for bilateral signal propagation between (i) an array 100 of elongate partition elements 102 that can sense or transmit free-space-propagating electromagnetic energy referenced by two-headed arrow 200, and (ii) a number of unbalanced electrical connections 300. Such an array of partition elements is disclosed in U.S. Pat. No. 7,420,522, the contents of which are hereby incorporated by reference.

The system 10 enables the low-loss conversion of the free-space-propagating electromagnetic energy 200 into "transverse electromagnetic" (TEM)-mode propagating energy in balanced transmission lines that are electronically coupled to the connections 300. The system 10 is also capable of reversing this conversion so that the system can also be used to transmit energy from the array 100. The partition elements 102 and the connections 300 are not part of the system 10 and are, therefore, illustrated in dashed-line form.

The system 10 includes a dielectric support substrate 12 with a number of electronically-conductive seats or pads 14 (e.g., copper) positioned (e.g., deposited, adhered, etc.) on substrate. The number of pads 14 is commensurate with the number of partition elements 102. The pads 14 are spaced apart from one another on the substrate 12. Each partition element 102 is coupled to the substrate 12 for mechanical support and for electrical connection to one of the pads. The method of mechanical coupling of the partition elements 102 to the substrate 12 is not a limitation of the present invention. The pads 14 are larger in area than the base 102B of the partition element 102 such that exposed regions 14A not covered by the base extend radially outward therefrom.

Adjacent ones of the partition elements 102 are electrically coupled to either side of a balanced transmission line. In the present invention, this is accomplished by a balun 16 that passes through the substrate 12 such that one end thereof resides in the space between two adjacent pads 14. The balun 16 has equal-width electrical conductors 18 and 20 on opposing faces of a dielectric/insulator 22. That is, each balun 16 defines a balanced transmission line.

As will be explained further below, each of the conductors 18 and 20 is electrically coupled to an exposed region 14A of one of pads 14. The other ends of the conductors 18 and 20 are electrically coupled to the unbalanced electrical connections 300. Supports 24 (or a unitary support assembly) can be provided to mechanically support the balun 16 in the spatial region between the substrate 12 and the connections 300. A variety of types of supports (e.g., rails) or support systems can be used without departing from the scope of the present invention.

Figure 2:
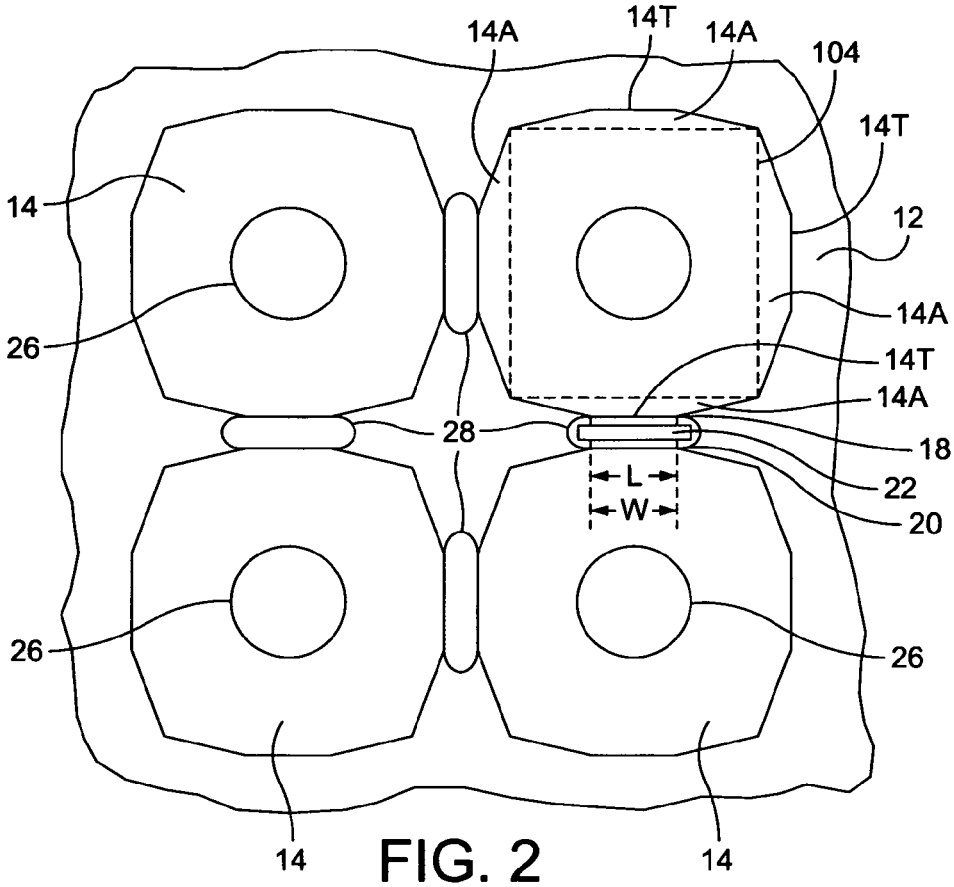
FIG. 2 is a plan view of four electronically-conductive pads formed on a dielectric substrate where each pad serves as a seat for one partition element in accordance with an embodiment of the present invention.

An embodiment of the present invention that provides low-loss mode transition and is capable of wideband operation is illustrated in FIGS. 2-5. Referring first to FIG. 2, a plan view of four pads 14 on the substrate 12 is illustrated. It is to be understood that many more than four pads would typically be provided. A mounting hole 26 can be provided centrally through each pad 14 and substrate 12 such that a mounting peg or screw (not shown) can be inserted therethrough and used to secure a partition element (not shown) on the pad as mentioned above. Again, the type of mechanical mounting of the partition elements is not a limitation of the present invention.

Balun receiving holes 28 are also formed in the substrate 12 between each adjacent pair of pads 14. The holes 28 are sized/shaped to facilitate insertion of a balun 16 (only one is shown in FIG. 3 for clarity of illustration) therethrough as will explained later herein.

In the illustrated embodiment, the pads 14 are shaped for cooperation with a partition element having a square base. This type of partition element polarizes incident electromagnetic energy into two orthogonal polarization components. The square base will rest on one of the pads 14 so that it is electrically coupled, thereto. More specifically, the pads 14 are configured such that a square base will overlay or cover an inscribed square on the pad as indicated by the square defined by dashed lines 104. For clarity of illustration, this is shown only on one pad 14. With the square base of a partition element inscribed on the pad 14; four exposed regions 14A are defined with each exposed region 14A lying along an edge of the square 104. In the illustrated embodiment, each exposed region 14A is a symmetrical trapezoid with outboard edge or top thereof 14T being parallel to a side of square the 104. For greatest efficiency (i.e., lowest loss), the length "L" of top 14T should be equal to the width "W" of the electrical conductors 18 and 20. The top 14T should, be aligned with the width of one of the conductors 18 and 20. This relationship is illustrated in FIG. 2 where one balun 16 is shown extending through one hole 28 with the conductors 18 and 20 aligned with a corresponding top 14T associated with two adjacent pads 14.

Figure 3:
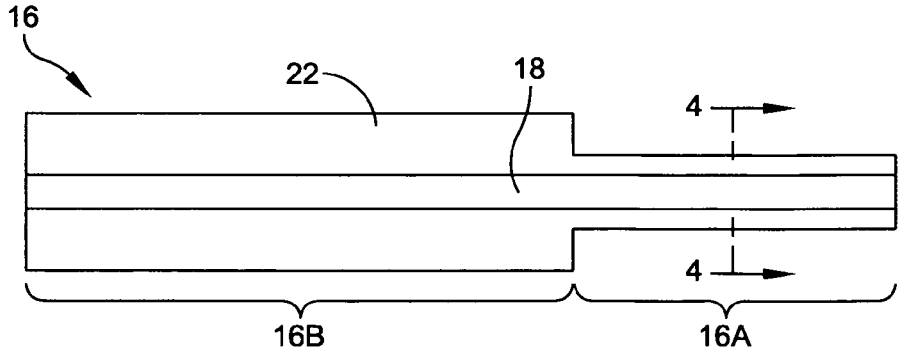
FIG. 3 is a plan view of a balun with an electrically-conductive trace deposited on a face thereof.
Figure 4:
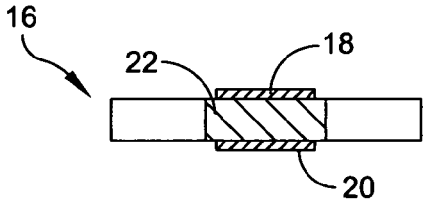
FIG. 4 is a cross-sectional view of the balun in FIG. 3 taken along reference line 4-4 thereof.

Referring now to FIGS. 3 and 4, a plan and cross-sectional view of an exemplary balun 16 are illustrated. A dielectric/insulator 22 (e.g., conventional printed circuit board substrate material) has equal-width copper conductive traces on opposing faces thereof. In the illustrated embodiment, the balun 16 has a narrow or tongue portion 16A sized to cooperate with one of the holes 28 (FIG. 2). A wider portion 16B extends as a tongue portion to an opposing end that will serve as the connection point for the connections 300 (FIG. 1). Any additional electronics required for the system 10 can be mounted on the dielectric/insulator 22 along the portion 16B.

Figure 5:
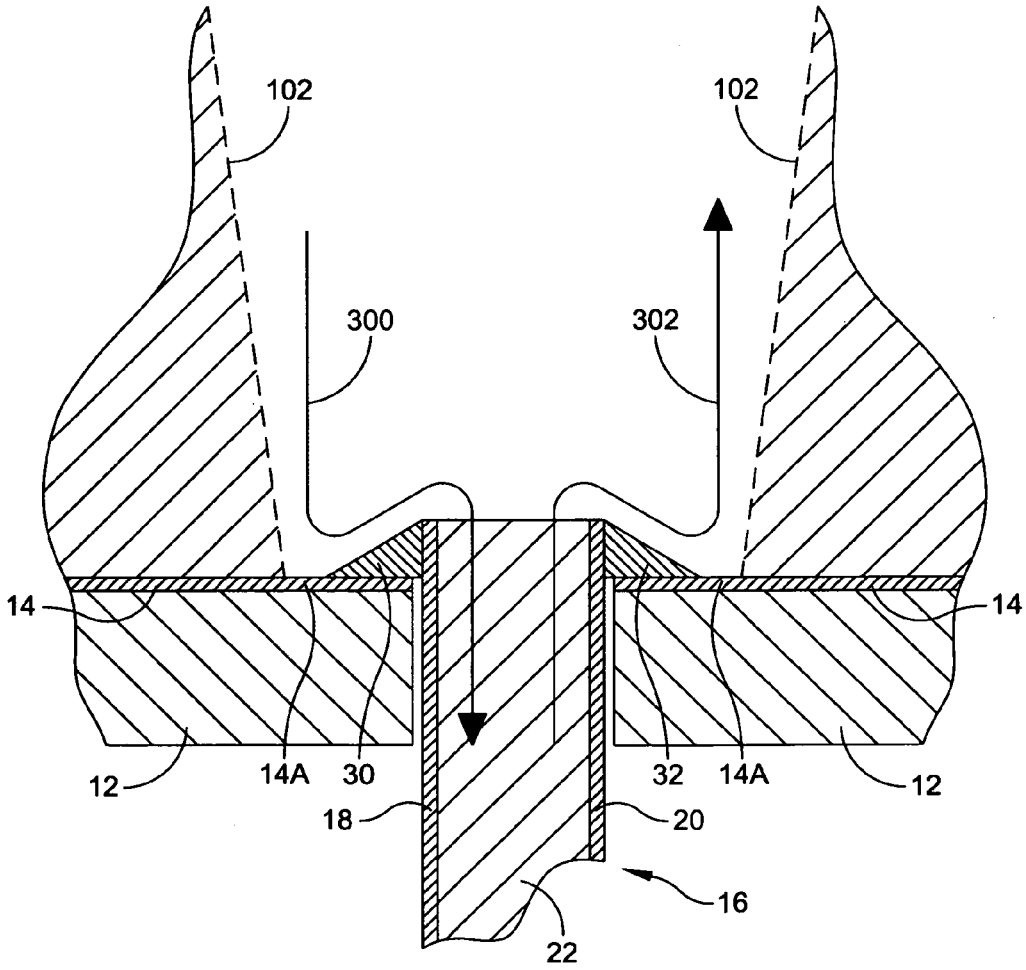
FIG. 5 is an enlarged cross-sectional view of a portion of a propagating mode transition system in accordance with an embodiment of the present invention illustrating the electrical connections provided thereby and the differential current flows that are supported by the system.

Referring now to FIG. 5, an enlarged cross-sectional view of a portion of a propagating mode transition system in accordance with embodiment of the present invention between two adjacent partition elements 102 is illustrated. With the tongue portion 16A of the balun 16 protruding through the hole 28, the conductors 18 and 20 are aligned with part of (e.g., top 14T as illustrated in the embodiment shown in FIG. 2) the exposed region 14A of pad 14 associated with one of the two adjacent partition elements 102.

In this position, each of the conductors 18 and 20 is electrically-coupled to the exposed region 14A that it faces using a low-loss solder filet 30 and 32, respectively. The term "low-loss" as it refers to the solder filets 30 and 32 is defined as solder that minimizes the skin-depth $I^2R$ (or power) losses at the frequency of operation of the system. That is, the solder should be selected to minimize the effects of solder-junction losses at the system operating frequency. Such solder selection is known in the art.

In use, a differential current flows on the surfaces of adjacent partition elements 102 as referenced by signal current path arrows 300 and 302. The differential current is guided between conductors 18 and 20 as well as a respective one of exposed regions 14A by solder filets 30 and 32. In accordance with a well-known property of high-frequency currents known as the "skin effect," the dominant current flow is restricted to the conductor's surface such that the current paths 300 and 302 will flow along the surface of the conductors 18 and 20. Since the conductors 18 and 20 are the same width and oppose one another on either side of the dielectric/insulator 22, the current paths 300 and 302 flow along the surfaces of the conductors 18 and 20 that face the dielectric/insulator 22.

Further and as mentioned above, the lowest loss or highest efficiency is achieved when the width of conductors 18 and 20 is matched to and aligned with the length of the top 14T (see FIG. 2). This ensures a smooth (or minimally-interrupted) flow of current between the partition element 102 and the conductors 18 and 20.

The present invention is readily configured for wideband operation. To illustrate this, a brief example is presented herein. A well-known property of circuit theory is that parts of electrical circuits that are less than one-tenth wavelength at a frequency of interest can be treated as "lumped" as opposed to "distributed."

In the present invention, the largest dimension in the propagating mode transition system is the separation between the bases of two adjacent partition elements. By way of illustrative example, if this separation distance is 0.213 inches, this translates to a wavelength at 55.5 gigahertz (GHz). For this example, the mode transition system of the present invention can be treated as a simple lumped circuit at frequencies less than 5 GHz (i.e., less than one-tenth of 55.5 GHz). Further, the low-frequency limit for the propagating mode transition is approximately determined by the frequency at which the thickness of the conductors 18 and 20 is ten times the skin depth.

For example, if the conductors 18 and 20 are 0.01 inch-thick copper traces, the low-frequency limit for the mode transition would be the frequency at which the skin depth in copper is 0.001 inches, which occurs at approximately 5 mega hertz (MHz). Thus, for this example, the bandwidth of the mode transition extends from a low frequency of 5 MHz to a high frequency of 5 GHz for a high-to-low bandwidth ratio of 1000:1. The above theory allows the present invention to be easily scaled for a variety frequency/bandwidth requirements.

The advantages of the present invention are numerous. The propagating mode transition system provides low-loss wideband transition from free-space propagation to propagation in a balanced transmission line. The mode transition system provides for bilateral signal transfer; thereby, facilitating reception and transmission modes of operation.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for transitioning free-space-propagating electromagnetic energy interfaced using an array of elongate elements to transverse electromagnetic-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a base thereof, wherein portions of each of said pads not covered by the base are exposed with each of said portions comprising a trapezoid shape; and a plurality of baluns, each of said baluns extending through said substrate with one end thereof disposed between said portions of two adjacent ones of said pads, each of said baluns defined by a dielectric material sandwiched between two identical-width electrical conductors, each of said electrical conductors electrically coupled to one of said portions of said two adjacent ones of said pads.

2. A system as in claim 1, wherein a top of each said trapezoid shape is aligned with and matched in length to a width of a corresponding one of said electrical conductors of one of said baluns.

3. A system as for transitioning free-space-propagating electromagnetic energy interfaced using an array of elongate elements to transverse electromagnetic-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a base thereof, wherein portions of each of said pads not covered by the base are exposed;

a plurality of baluns, each of said baluns extending through said substrate with one end thereof disposed between said portions of two adjacent ones of said pads, each of said baluns defined by a dielectric material sandwiched between two identical-width electrical conductors, each of said electrical conductors electrically coupled to one of said portions of said two adjacent ones of said pads; and a plurality of supports coupled to said substrate for mechanically supporting said baluns.

4. A system for transitioning free-space-propagating electromagnetic energy interfaced using an array of elongate elements to transverse electromagnetic-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a base thereof, wherein portions of each of said pads not covered by the base are exposed;

a plurality of baluns, each of said baluns extending through said substrate with one end thereof disposed between said portions of two adjacent ones of said pads, each of said baluns defined by a dielectric material sandwiched between two identical-width electrical conductors, each of said electrical conductors electrically coupled to one of said portions of said two adjacent ones of said pads; and low-loss solder for electrically coupling each of said electrical conductors to one of said portions.

5. A system for transitioning free-space-propagating electromagnetic energy interfaced using an array of elongate elements to transverse electromagnetic (TEM)-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a base thereof, wherein portions of each of said pads not covered by the base are exposed with each of said portions comprising a trapezoid shape; and a plurality of balanced transmission lines, each of said balanced transmission lines having a first end extending through said substrate and disposed between said portions of two adjacent ones of said pads, each of said balanced transmission lines including two same-width electrical traces separated by an insulator, each of said traces electrically coupled using low-loss solder to one of said portions of said two adjacent ones of said pads, each of said balanced transmission lines extending to a second end thereof that is adapted to be coupled to an unbalanced electrical connection.

6. A system as in claim 5, wherein a top of each said trapezoid shape is aligned with and matched in length to a width of a corresponding one of said traces.

7. A system for transitioning free-space-propagating electromagnetic energy interfaced using an array of elongate elements to transverse electromagnetic (TEM)-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a base thereof, wherein portions of each of said pads not covered by the base are exposed;

a plurality of balanced transmission lines, each of said balanced transmission lines having a first end extending through said substrate and disposed between said portions of two adjacent ones of said pads, each of said balanced transmission lines including two same-width electrical traces separated by an insulator, each of said traces electrically coupled using low-loss solder to one of said portions of said two adjacent ones of said pads, each of said balanced transmission lines extending to a second end thereof that is adapted to be coupled to an unbalanced electrical connection; and a plurality of supports coupled to said substrate for mechanically supporting said balanced transmission lines extending to said second end thereof.

8. A system for transitioning free-space-propagating electromagnetic energy interfaced using an array of elongate elements to transverse electromagnetic-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a square base thereof, wherein four trapezoid-shaped portions are defined and exposed for each of said pads with each of said portions being adjacent to one of four sides of said square base;

a plurality of baluns, each of said baluns extending through said substrate with one end thereof disposed between said portions of two adjacent ones of said pads at an outboard edge thereof that is parallel to one of the four sides of the square base, each of said baluns defined by a dielectric material sandwiched between two identical-width electrical conductors, each of said electrical conductors electrically coupled to one of said portions of said two adjacent ones of said pads; and a plurality of supports coupled to said substrate for mechanically supporting said baluns.

9. A system for transitioning free-space-propagating electromagnetic energy interfaced using an array of elongate elements to transverse electromagnetic-mode propagating energy, said system comprising:

a dielectric substrate;

an array of electrically-conductive pads, said pads arranged in spaced-apart fashion on said substrate, each of said pads adapted to be substantially covered by and electrically coupled to one of the elongate elements at a square base thereof, wherein four trapezoid-shaped portions are defined and exposed for each of said pads with each of said portions being adjacent to one of four sides of said square base;

a plurality of baluns, each of said baluns extending through said substrate with one end thereof disposed between said portions of two adjacent ones of said pads at an outboard edge thereof that is parallel to one of the four sides of the square base, each of said baluns defined by a dielectric material sandwiched between two identical-width electrical conductors, each of said electrical conductors electrically coupled to one of said portions of said two adjacent ones of said pads; and low-loss solder for electrically coupling each of said electrical conductors to one of said portions.

* * * * *